US011879229B2

(12) United States Patent
Ayers

(10) Patent No.: US 11,879,229 B2
(45) Date of Patent: Jan. 23, 2024

(54) MECHANICAL SOIL STABILIZER AND METHOD FOR SOIL STABILIZATION

(71) Applicant: Ryan Ayers, Sandyston, NJ (US)

(72) Inventor: Ryan Ayers, Sandyston, NJ (US)

( * ) Notice: Subject to any disclaimer, the term of this patent is extended or adjusted under 35 U.S.C. 154(b) by 405 days.

(21) Appl. No.: 17/139,218

(22) Filed: Dec. 31, 2020

(65) Prior Publication Data

US 2022/0205206 A1 Jun. 30, 2022

(51) Int. Cl.

| | |
|---|---|
| ***E02D 5/52*** | (2006.01) |
| ***E02D 5/48*** | (2006.01) |
| ***E02D 5/28*** | (2006.01) |
| ***E02D 3/12*** | (2006.01) |

(52) U.S. Cl.

CPC ..... *E02D 5/48* (2013.01); *E02D 3/12* (2013.01); *E02D 5/285* (2013.01); *E02D 5/523* (2013.01); *E02D 2200/1685* (2013.01); *E02D 2600/40* (2013.01)

(58) Field of Classification Search

CPC ..... E02D 5/48; E02D 5/223; E02D 5/285; E02D 5/523; E02D 2300/0032; E02D 2200/1642; E02D 2600/40; E02D 27/42; E02D 7/10; E02D 2250/00; E02D 3/12

See application file for complete search history.

(56) References Cited

U.S. PATENT DOCUMENTS

| | | | | |
|---|---|---|---|---|
| 4,052,827 | A * | 10/1977 | Yancey | E02D 5/80 52/156 |
| 4,882,891 | A * | 11/1989 | Sero | E02D 5/74 52/741.15 |
| 5,899,030 | A * | 5/1999 | Barefield | E04H 12/2215 403/374.1 |
| 10,508,406 | B1 * | 12/2019 | Childress | E02D 7/00 |
| 2016/0186403 | A1 * | 6/2016 | Tomchesson | E02D 5/54 405/252.1 |
| 2018/0135269 | A1 * | 5/2018 | Reusing | E02D 5/223 |
| 2018/0148901 | A1 * | 5/2018 | Kemp | E02D 5/223 |

FOREIGN PATENT DOCUMENTS

| | | | | |
|---|---|---|---|---|
| KR | 2012101801 | A * | 9/2012 | |
| KR | 1909396 | B1 * | 10/2018 | E02D 5/223 |
| KR | 2020074495 | A * | 6/2020 | E02D 5/223 |

* cited by examiner

*Primary Examiner* — Benjamin F Fiorello
*Assistant Examiner* — Stacy N Lawson
(74) *Attorney, Agent, or Firm* — The Webb Law Firm

(57) ABSTRACT

A soil stabilizer assembly may include a pipe with a first end, a second end, and a sidewall defining a hollow shaft extending between the first and second ends; a stabilizer connectable to the second end of the pipe with a hollow body and a plurality of extensions extending radially outward from the body; and a cap connectable to the first end of the pipe including a receiving portion for receiving the first end of the pipe and a plate extending across the receiving portion. The hollow body of the stabilizer may be configured to receive the second end at least a portion of the sidewall of the pipe therethrough. The receiving portion of the cap may be configured to receive the first end and at least a portion of the hollow shaft of the pipe therein. The hollow shaft, hollow body, and receiving portion may be coaxially arranged.

20 Claims, 12 Drawing Sheets

MECHANICAL SOIL STABILIZER AND METHOD FOR SOIL STABILIZATION

BACKGROUND OF THE DISCLOSURE

Field of the Disclosure

The present disclosure relates to a soil stabilizer, a system of soil stabilizers, and a method of using a soil stabilizer, and specifically, to a soil stabilizer having a pipe, stabilizer, and cap wherein the stabilizer provides support for the pipe, so that the pipe can be more easily driven into the ground.

Description of Related Art

Due to both human activity and natural causes, forces impacting soil can cause the soil to loosen or subside over time. In order to hold back hillsides and other portions of the ground near places like construction zones, soil is typically removed, H-beams or other support beams are placed into the ground, and concrete is poured around the H-beams, holding the H-beams in the ground and forming a type of retaining wall. In other instances, sheet piles may connected and placed next to each other at or near subsiding hills. This process still involves digging out an area of the hill for placement of the sheet piles. These processes are time consuming and labor intensive, requiring large amounts of heavy machinery to be moved to dig out a hillside in order to further stabilize the soil. Therefore, it is desirable to have a simple stabilizing assembly that is applied to the soil in a less labor-intensive process, such as a process that avoids the use of drilling into the ground or the use of concrete, in order to stabilize a hillside or other portions of the soil.

SUMMARY OF THE INVENTION

The present disclosure is directed to a soil stabilizer that may include a pipe with a first end configured to remain at least partially above the ground, a second end configured to extend into the ground, and a sidewall defining a hollow shaft extending between the first end and the second end; a stabilizer connectable to the second end of the pipe, the stabilizer including a hollow body and a plurality of extensions extending radially outward from the body; and a cap connectable to the first end of the pipe, the cap comprising a receiving portion configured for receiving the second end of the pipe and a plate extending across the receiving portion. The hollow body of the stabilizer may be configured to receive the second end and at least a portion of the sidewall of the pipe therethrough. The receiving portion of the cap may be configured to receive the first end and at least a portion of the sidewall of the pipe therein. The hollow shaft of the pipe, the hollow body of the stabilizer, and the receiving portion of the cap may be coaxially arranged.

In some embodiments or aspects, the second end of the pipe may include a bevel at a terminal edge. The pipe may be made from a polymer. The pipe may include a plurality of anti-rotational supports extending from an outer surface of the sidewall, and the plurality of anti-rotational supports may extend at least partially into the ground. The plurality of anti-rotational supports may be T-bars. The plurality of anti-rotational supports comprise four T-bars equally spaced apart from each other about a circumference of the sidewall and positioned between the first end and the second end. The ends of the T-bars nearest the second end of the pipe may include a bevel at a terminal edge. The plurality of extensions may be four extensions.

In some embodiments or aspects, each of the plurality of extensions may terminate in a cylinder, and at least one cylinder may include a central hole configured to receive a stabilizing pin therethrough. Proximate the second end of the pipe, the hollow shaft of the pipe may include a first plurality of holes, and the receiving portion of the cap may include a second plurality of holes. The first and second pluralities of holes may be configured to align in order to receive at least one attachment element therethrough to secure the cap to the sidewall. The plate of the cap may include an opening coaxial with the hollow shaft of the pipe, the hollow body of the stabilizer, and the receiving portion of the cap. The opening may be configured to receive a support mechanism therethrough. The support mechanism may be configured to attach the soil stabilizer to a different soil stabilizer.

In some embodiments or aspects, a ground retention system may include a plurality of soil stabilizers, each soil stabilizer including a pipe including a first end, a second end, and a sidewall extending between the first end and the second end, the sidewall defining a hollow shaft; a stabilizer including a hollow body and a plurality of extensions extending radially outward from the hollow body; and a cap including a receiving portion configured for receiving the second end of the pipe and a plate extending across the receiving portion. The hollow body of the stabilizer may be configured to receive the second end and at least a portion of the sidewall of the pipe therethrough. The second end and at least a portion of the sidewall of the pipe may extend at least partially into the ground. The hollow shaft of the pipe, the hollow body of the stabilizer, and the receiving portion of the cap may be coaxial. Each of the soil stabilizers may be separated from an adjacent soil stabilizer by a distance.

In some embodiments or aspects, the second end of the pipe may include a bevel at a terminal edge. The pipe may include a plurality of anti-rotational supports extending from an outer surface of the sidewall, and at least a portion of the plurality of anti-rotational supports may extend into the ground. The plurality of anti-rotational supports may be T-bars extending along at least a portion of a length of the sidewall between the first and second ends. An end of the T-bars nearest the second end of the pipe may include a bevel at a terminal edge. The plate of the cap may be configured to receive a support mechanism therein, and the support mechanism may be coaxial with the hollow shaft of the pipe, the hollow body of the stabilizer, and the receiving portion of the cap. The support mechanism of each pipe assembly is configured to connect with the support mechanisms of at least one other pipe assembly.

In some embodiments or aspects, a method of stabilizing a portion of soil may include the steps of: inserting a stabilizer to a first distance into the ground, the stabilizer including a hollow body and a plurality of extensions extending from the hollow body; aligning a pipe within the hollow body of the stabilizer, the pipe including a first end, a second end, and a sidewall extending therebetween, the sidewall defining a hollow shaft and comprising a plurality of anti-rotational supports extending between a first end and a second end along at least a portion of a length of the sidewall; driving the first end of the pipe into the ground a second distance, the second distance greater than the first distance; and applying a cap to an end of the pipe remaining above ground. The hollow shaft of the pipe, the hollow body of the stabilizer, and the receiving portion of the cap may be coaxial. After the driving step, the rotational supports extend at least partially in the ground.

In some embodiments or aspects, the present disclosure may be characterized by one or more of the following numbered clauses:

Clause 1. A soil stabilizer assembly comprising: a pipe comprising a first end configured to remain at least partially above the ground, a second end configured to extend into the ground, and a sidewall defining a hollow shaft extending between the first end and the second end; a stabilizer connectable to the second end of the pipe, the stabilizer comprising a hollow body and a plurality of extensions extending radially outward from the body; and a cap connectable to the first end of the pipe, the cap comprising a receiving portion configured for receiving the second end of the pipe and a plate extending across the receiving portion, wherein the hollow body of the stabilizer is configured to receive the second end and at least a portion of the sidewall of the pipe therethrough, wherein the receiving portion of the cap is configured to receive the first end and at least a portion of the sidewall of the pipe therein, and wherein the hollow shaft of the pipe, the hollow body of the stabilizer, and the receiving portion of the cap are coaxially arranged.

Clause 2. The soil stabilizer assembly of clause 1, wherein the first end of the pipe comprises a bevel at a terminal edge.

Clause 3. The soil stabilizer assembly of clause 1 or 2, wherein the pipe is made from a polymer.

Clause 4. The soil stabilizer assembly of any of clauses 1-3, wherein the pipe comprises a plurality of anti-rotational supports extending from an outer surface of the sidewall, and wherein the plurality of anti-rotational supports extend at least partially into the ground.

Clause 5. The soil stabilizer assembly of any of clauses 1-4, wherein the plurality of anti-rotational supports are T-bars.

Clause 6. The soil stabilizer assembly of any of clauses 1-5, wherein the plurality of anti-rotational supports comprise four T-bars equally spaced apart from each other about a circumference of the sidewall and positioned between the first end and the second end.

Clause 7. The soil stabilizer assembly of any of clauses 1-6, wherein the ends of the T-bars nearest the second end of the pipe each comprise a bevel at a terminal edge.

Clause 8. The soil stabilizer assembly of any of clauses 1-7, wherein the plurality of extensions is four extensions.

Clause 9. The soil stabilizer assembly of any of clauses 1-8, wherein each of the plurality of extensions terminates in a cylinder, and wherein at least one cylinder comprises a central hole configured to receive a stabilizing pin therethrough.

Clause 10. The soil stabilizer assembly of any of clauses 1-9, wherein, proximate the second end of the pipe, the hollow shaft of the pipe comprises a first plurality of holes, and wherein the receiving portion of the cap comprises a second plurality of holes, the first and second pluralities of holes are configured to align in order to receive at least one attachment element therethrough to secure the cap to the sidewall.

Clause 11. The soil stabilizer assembly of any of clauses 1-3, wherein the plate of the cap comprises an opening coaxial with the hollow shaft of the pipe, the hollow body of the stabilizer, and the receiving portion of the cap, the opening configured to receive a support mechanism therethrough.

Clause 12. The soil stabilizer assembly of any of clauses 1-3, wherein the support mechanism is configured to attach the soil stabilizer to a different soil stabilizer.

Clause 13. A ground retention system, the system comprising: a plurality of soil stabilizers, each soil stabilizer comprising: a pipe comprising a first end, a second end, and a sidewall extending between the first end and the second end, the sidewall defining a hollow shaft; a stabilizer comprising a hollow body and a plurality of extensions extending radially outward from the hollow body; and a cap comprising a receiving portion configured for receiving the second end of the pipe and a plate extending across the receiving portion, wherein the hollow body of the stabilizer is configured to receive the second end and at least a portion of the sidewall of the pipe therethrough, wherein the second end and at least a portion of the sidewall of the pipe extend at least partially into the ground, wherein the hollow shaft of the pipe, the hollow body of the stabilizer, and the receiving portion of the cap are coaxial, and wherein each of the pipe assemblies is separated from an adjacent pipe assembly by a distance.

Clause 14. The ground retention system of clause 13, wherein the second end of the pipe comprises a bevel at a terminal edge.

Clause 15. The ground retention system of clauses 13 or 14, wherein the pipe comprises a plurality of anti-rotational supports extending from an outer surface of the sidewall, and wherein at least a portion of the plurality of anti-rotational supports extend into the ground.

Clause 16. The ground retention system of any of clauses 13-15, wherein the plurality of anti-rotational supports are T-bars extending along a least a portion of a length of the sidewall between the first and second ends.

Clause 17. The ground retention system of any of clauses 13-16, wherein an end of the T-bars nearest the second end of the pipe comprise a bevel at a terminal edge.

Clause 18. The ground retention system of any of clauses 13-17, wherein the plate of the cap is configured to receive a support mechanism therein, the support mechanism being coaxial with the hollow shaft of the pipe, the hollow body of the stabilizer, and the receiving portion of the cap.

Clause 19. The ground retention system of any of clauses 13-18, wherein the support mechanisms of each pipe assembly are configured to connect with the support mechanisms of at least one other pipe assembly.

Clause 20. A method of stabilizing a portion of soil, the method comprising the steps of: inserting a stabilizer to a first distance into the ground, the stabilizer comprising a hollow body and a plurality of extensions extending from the hollow body; aligning a pipe within the hollow body of the stabilizer, the pipe comprising a first end, a second end, and a sidewall extending therebetween, the sidewall defining a hollow shaft and comprising a plurality of anti-rotational supports extending between a first end and a second end along at least a portion of a length of the sidewall; driving the first end of the pipe into the ground a second distance, the second distance greater than the first distance; and applying a cap to an end of the pipe remaining above ground, wherein the hollow shaft of the pipe, the hollow body of the stabilizer, and the receiving portion of the cap are coaxial, and wherein, after the driving step, the rotational supports extend at least partially into the ground.

BRIEF DESCRIPTION OF THE DRAWING(S)

DESCRIPTION OF THE INVENTION

Figure 1:
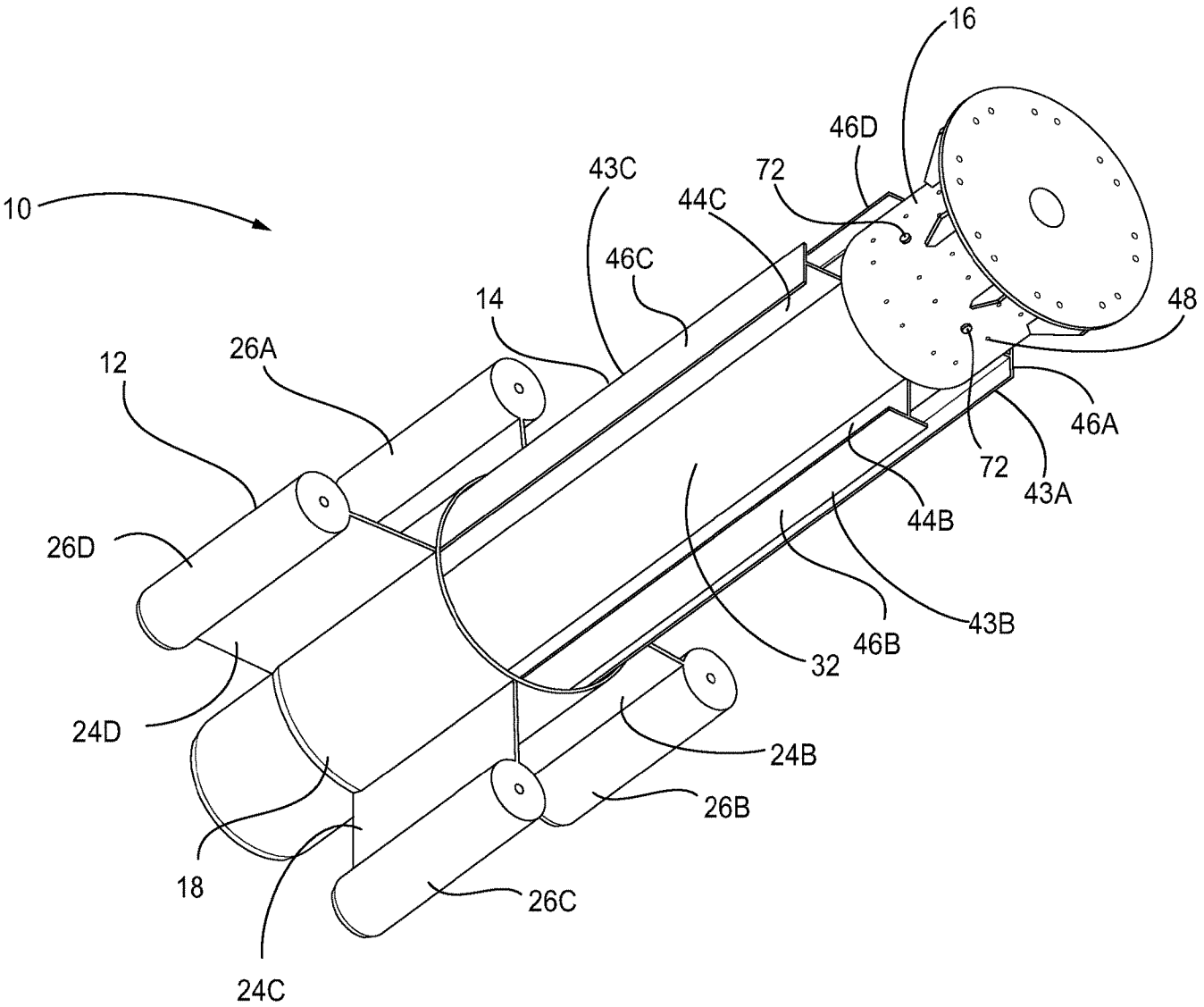
FIG. 1 is a perspective view of a soil stabilizer according to one embodiment or aspect of the present disclosure.

As used herein, the singular forms of "a", "an", and "the" include plural referents unless the context clearly dictates otherwise.

Spatial or directional terms, such as "left", "right", "inner", "outer", "above", "below", and the like relate to the disclosure as shown in the drawing figures and are not to be considered as limiting, as the disclosure can assume various alternative orientations.

All numbers and ranges used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

The term "at least" is synonymous with "greater than or equal to".

The term "not greater than" is synonymous with "less than or equal to".

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection that is from 85° to 90°, or from 87° to 90°, or from 88° to 90°, or from 89° to 90°, or from 89.5° to 90°, or from 89.75° to 90°, or from 89.9° to 90°, inclusive of the recited values.

The present disclosure is directed to a soil stabilizer, a system of soil stabilizers, and a method of using such assemblies. The soil stabilizers may be used to hold back a hillside or to prevent sliding of the earth due to construction, work, or weather that may cause the soil to weaken.

Figure 2:
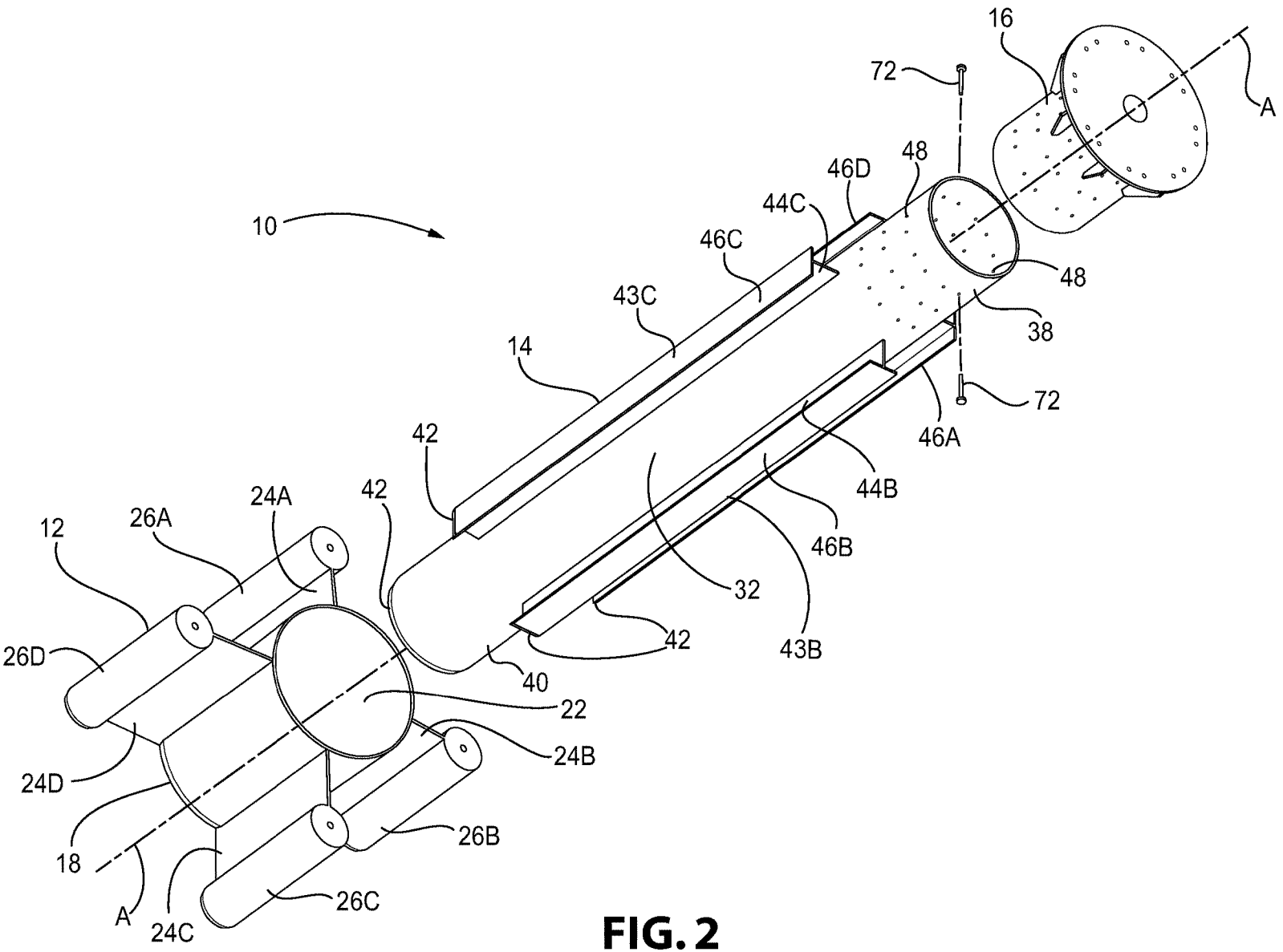
FIG. 2 is an exploded view of the soil stabilizer of FIG. 1.
Figure 3A:
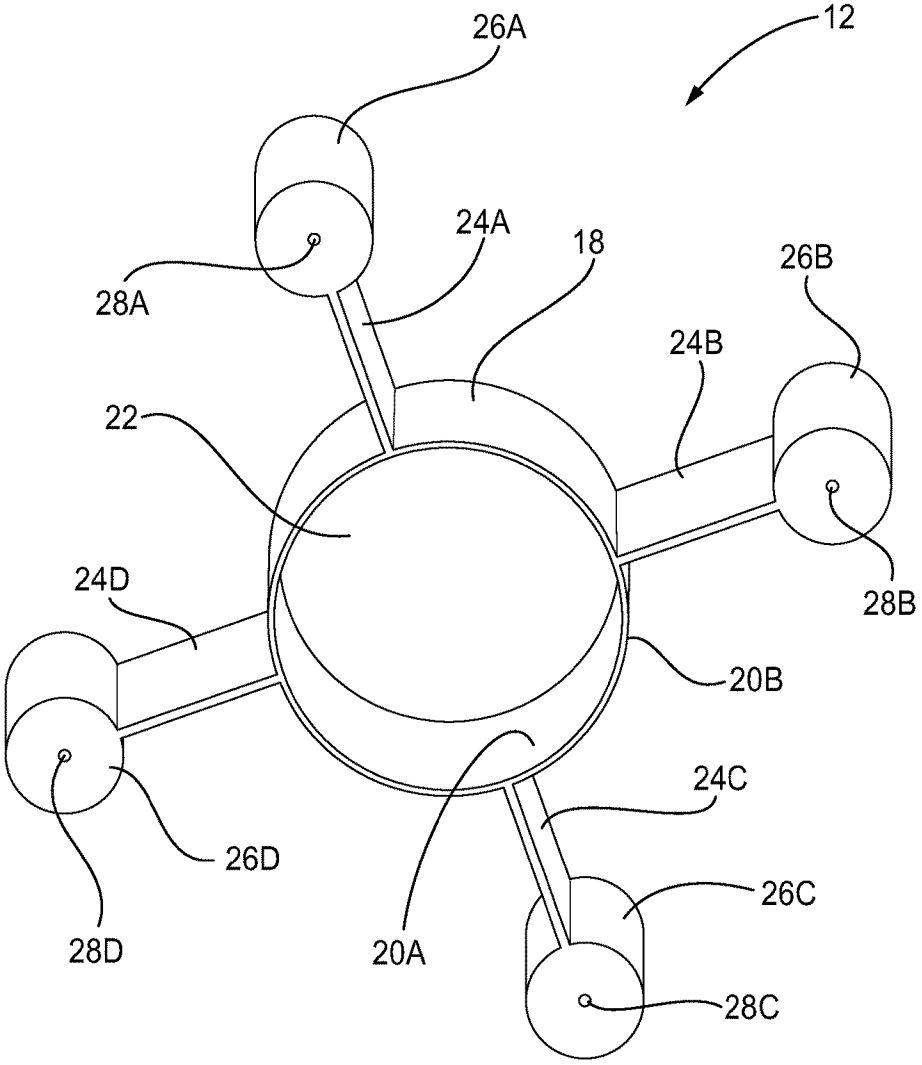
FIG. 3A is a top view of a stabilizer according to one embodiment or aspect of the present disclosure.
Figure 3B:
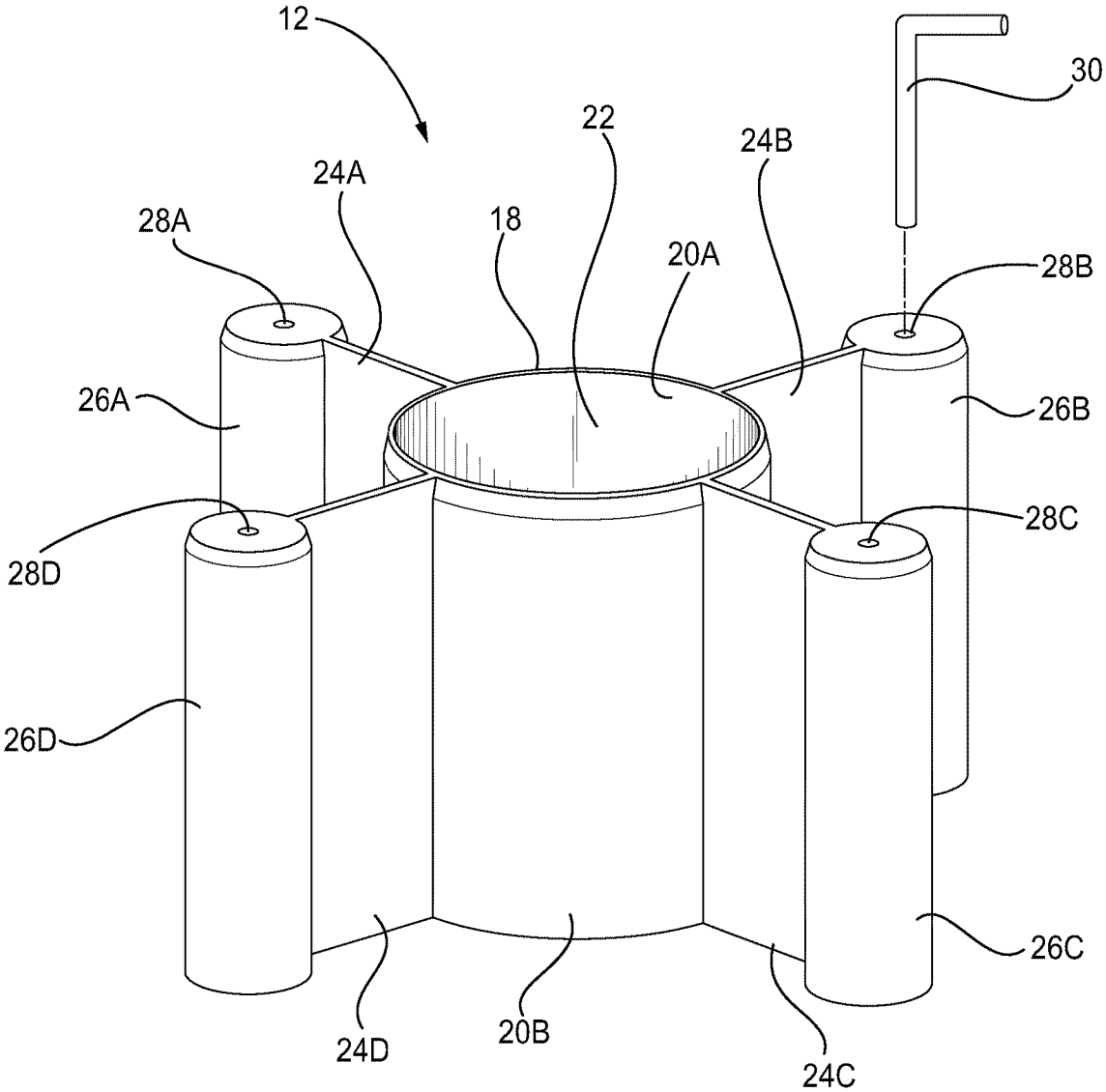
FIG. 3B is a perspective view of the stabilizer of FIG. 3A with a stabilizer pin.
Figure 6:
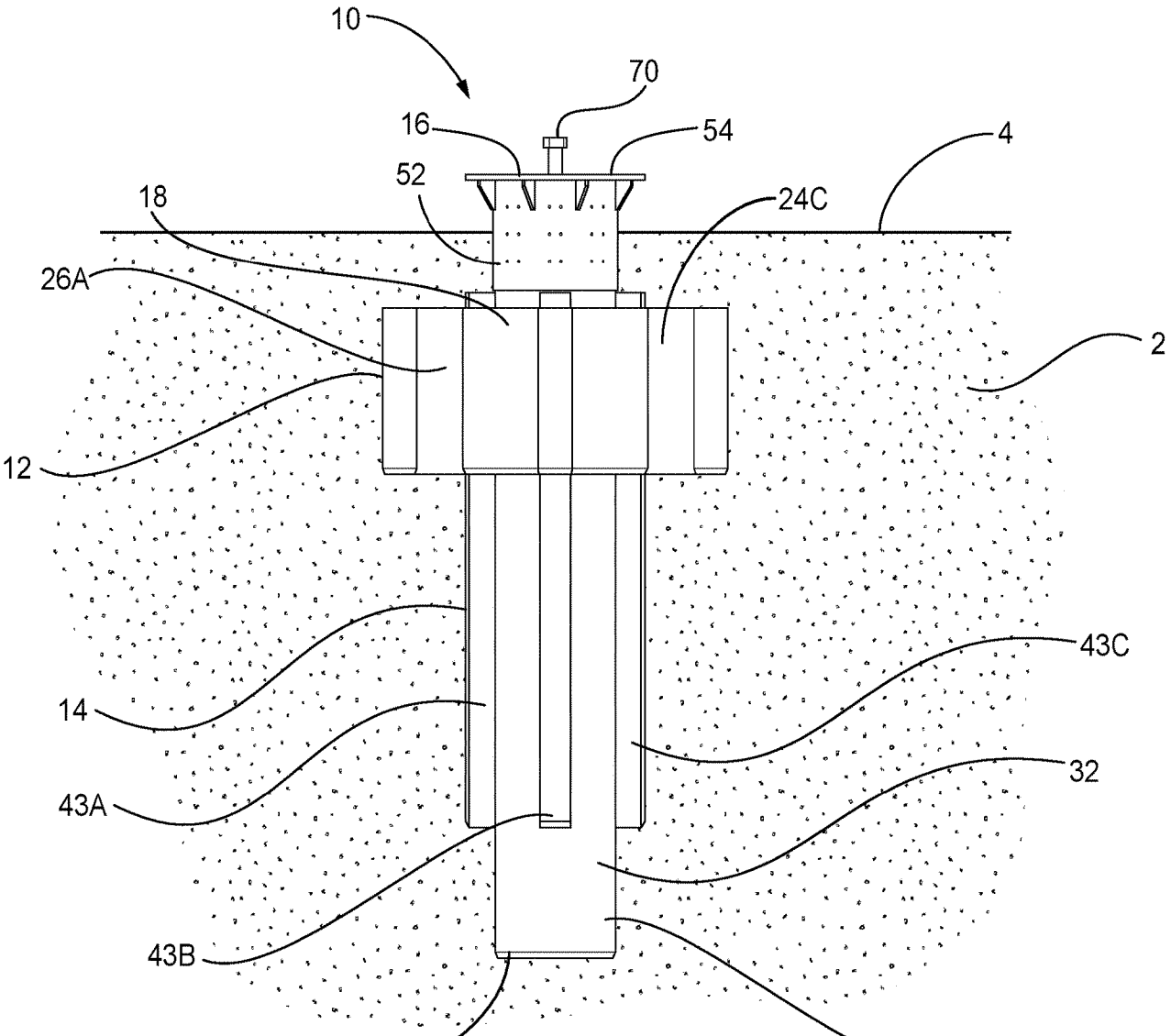
FIG. 6 is a side view of a soil stabilizer within the ground according to one embodiment or aspect of the present disclosure.
Figure 7:
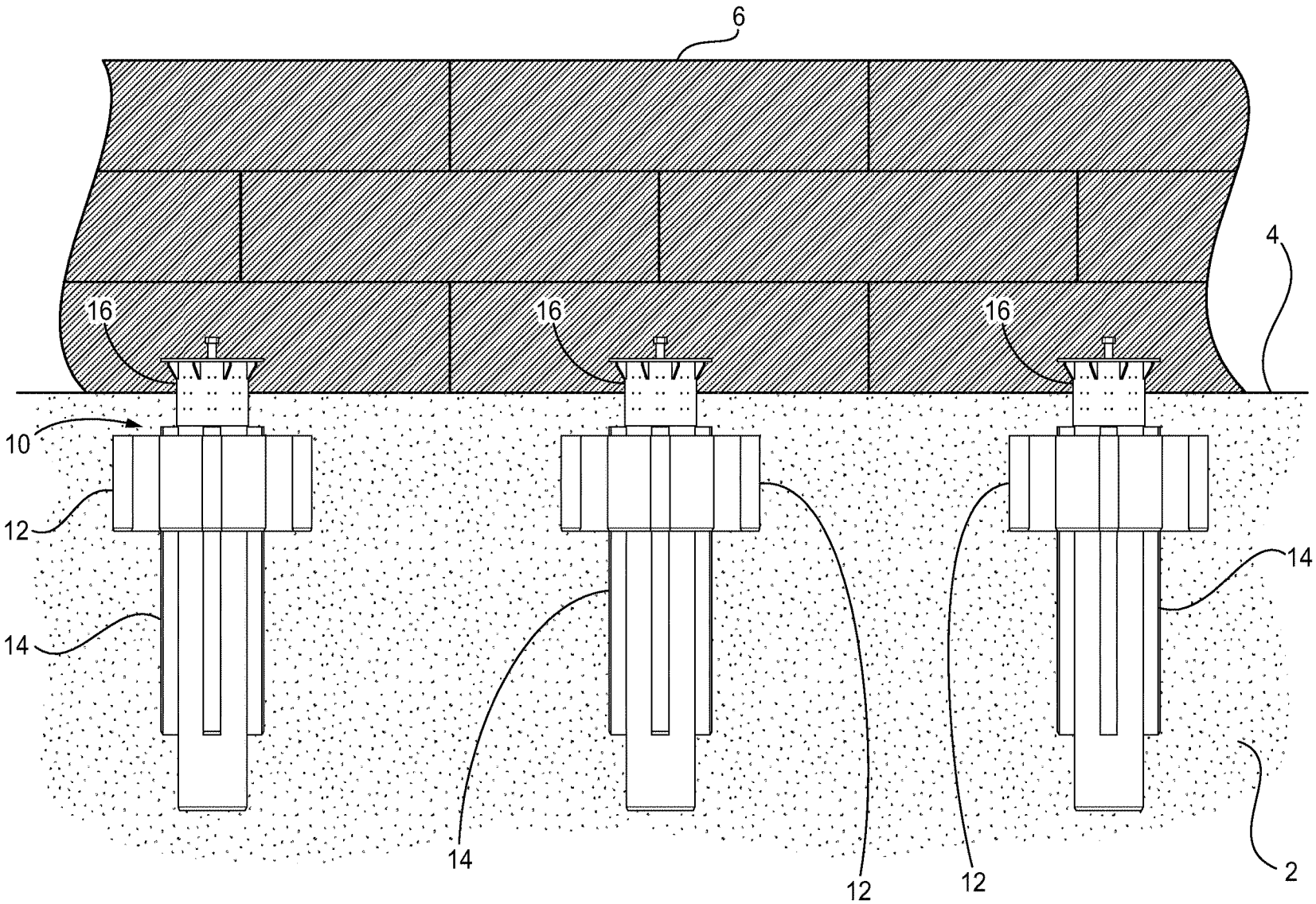
FIG. 7 is a side view of a soil stabilizer system according to another embodiment or aspect of the present disclosure.

With reference to FIGS. 1 and 2, a soil stabilizer 10 according to one embodiment or aspect of the present disclosure is shown. The soil stabilizer 10 includes a stabilizer 12, pipe 14, and cap 16 that, when assembled, share a common axis A (shown in FIG. 2). The stabilizer 12 fits over the pipe 14, so that the pipe 14 can slide through the stabilizer 12. The cap 16 fits about and is fastened to one end of the pipe 14. Some or all of the pipe assembly 10 fits into the ground 2 as shown in FIGS. 6 and 7. By driving the pipe 14 and placing the pipe assembly 10 into the ground 2, the ground is compacted around the pipe 14, which provides stability to the area of the ground located around the pipe assembly 10. The specific features and makeup of the pipe 14 will be dependent on the soil conditions at the location where the pipe 14 is placed. This means that the pipe 14 is geotechnically engineered based on the conditions of the soil and the desired use of the pipe 14. The specific elements of the pipe assembly 10 and the specific relationships between the stabilizer 12, pipe 14, and cap 16 will now be described.

With reference to FIGS. 1-3B, the stabilizer 14 is shown according to one aspect or embodiment of the present disclosure. The stabilizer 12 may be made of steel, a polymer, a polymer composite resin, or other materials known to those having skill in the art. The stabilizer 12 includes a hollow body 18 that is sized to fit the pipe 14 therethrough. The hollow body includes an inner surface 20A for receiving the pipe 14 and an outer surface 20B for contacting the ground. The inner surface 20A of the hollow body 18 defines a passage 22 through which the pipe 14 extends. The hollow body 18 and passage 22 may extend 12-48 inches in length, the entirety of which overlaps a portion of the pipe 14. It is contemplated that lengths greater than 48 inches may be used depending on the soil conditions and size of the pipe 14 to be used. As shown, the hollow body 18 and passage 22 are cylindrical in shape; however, the hollow body 18 and passage 22 may take other shapes depending on the shape of the pipe 14 and its associated features which will be described in more detail below. The diameter or cross sectional area of the hollow body 18 also depends on the shape and the size of the pipe 14 extending through the body 18.

Extending radially outward from the hollow body 18 are extensions 24A, 24B, 24C, 24D. The extensions 24A, 24B, 24C, 24D may be anywhere from 6-48 inches away from the hollow body 18 and terminate at cylinders 26A, 26B, 26C, 26D. As shown, the extensions 24A, 24B, 24C, 24D are plates that have a length substantially similar to that of the hollow body 18. The extensions 24A, 24B, 24C, 24D may be welded to or molded together with the hollow body 18. The extensions 24A, 24B, 24C, 24D may take other shapes such as rods or bars extending from the hollow body 18. The cylinders 26A, 26B, 26C, 26D may be anywhere from 8-24 inches in diameter. The cylinders 26A, 26B, 26C, 26D also have a length that is same as that of the hollow body 18 of the stabilizer 12. The bottom ends of the cylinders 26A, 26B, 26C, 26D and the hollow body 18 are flush so that the stabilizer 12 rests level within the ground when it is in use. As shown, pairs of the extensions 24A, 24B, 24C, 24D and cylinders 26A, 26B, 26C, 26D oppose each other on different sides of the hollow body 18. This forms a substantially X-shaped stabilizer 12. It is contemplated that the extensions 24A, 24B, 24C, 24D and cylinders 26A, 26B, 26C, 26D may extend from the hollow body 18 at different angles depending on the makeup of the ground on which the stabilizer 12 rests. Other amounts of extensions 24A, 24B, 24C, 24D and cylinders 26A, 26B, 26C, 26D less than or greater than four may also be used.

When in use, the stabilizer 12 may be placed anywhere from 1-10 feet into the ground. In the some applications, the stabilizer is placed 2-4 feet into the ground. The extensions 24A, 24B, 24C, 24D and cylinders 26A, 26B, 26C, 26D enlarge the footprint of the stabilizer, so that it does not sink into the ground after it is put into place. To further hold the stabilizer, at least one stabilizing pin 30, shown in FIG. 3B, may extend through holes 28A, 28B, 28C, 28D that extend through the entire length of the cylinders 26A, 26B, 26C, 26D. The stabilizing pin 30 extends through the holes 28A, 28B, 28C, 28D so that a portion of the stabilizing pin 30 extends into the ground to prevent the stabilizer 12 from moving laterally with respect the ground. A more detailed description of the construction of the pipe assembly 10 will be described below.

With reference to FIGS. 1, 2, and 4A-4D, the pipe 14 according to one embodiment or aspect of the present disclosure is shown Like the stabilizer 12, the pipe 14 and its associated features may be made of steel, a polymer, a polymer composite resin, or another material known to those having skill in the art. The pipe includes a hollow pipe body 32 having an inner surface 34A and an outer surface 34B. The inner surface 34A of the hollow pipe body 32 defines a passage 36. The passage 36 extends between a first end 38 and a second end 40 of the pipe body 32. As the pipe 14 is driven into the ground, the passage 36 fills with earth, and the outer surface 34B of the hollow pipe body 32 is surrounded by earth. To facilitate the movement of earth through the passage 36, the inner surface 34A does not have any engineered characteristics, such as skin friction. To facilitate the driving action of the pipe 14 into the ground, the second end 40 of the pipe includes a bevel 42. The edge of the bevel 42 helps the pipe cut into the ground and push soil to the outer surface 34B side of the pipe body 32. During use, the beveled second end 40 of the pipe 14 is aligned within the passage 22 of the stabilizer 12 and driven into the ground through the passage 22. Due to the presence of the stabilizer 12 and the bevel 42, the pipe 14 is more easily controlled during the driving process. This means less force and less equipment is required to align the pipe 14 at its desired location and to drive it into the ground. In other words, proper placement of the stabilizer 12 on and within the ground ensures that the pipe 14 and pipe body 32 are properly aligned with the ground without the need for additional machinery to hold the pipe 14 in place above the ground prior to driving. When driving occurs, the bevel 42 acts like a knife against the soil, and pushes it away from the outer surface 34B of the pipe body 32, so that the pipe 14 can more easily slide into the earth.

The pipe 14 may be 20-30 feet in length between the first end 38 and the second end 40. Depending on the conditions of the soil, pipes 14 up to 50 feet in length may also be used. Again, depending on the conditions of the soil and based on the desired use for the pipe assembly 10, the entire length of the pipe 14 can be placed into the ground or a portion of the pipe 14 may remain above the ground. For example, soft soil, like clay, is more susceptible to movement and subsidence. In these conditions, a longer length of pipe 14 may be desired in order to compact and stabilize a greater amount of earth around the pipe 14. In harder soil conditions, like when rock or shale is present, a shorter length of pipe 14 may be desired due to the resilient nature of the rock within the soil. The specific uses and arrangements of the pipes 14 within the soil stabilizer 10 will be described in greater detail below.

When the pipe 14 is placed into the ground, it experiences various forces due to the moving earth. These forces may occur naturally or artificially. However they are created, these forces may act rotationally on the pipe 14 as it sits in the ground. Typically, the forces provide lateral pressure at different points within the soil. The lateral pressure pushes the pipe as if it is going to turn over on itself within the earth. These pressures may cause the pipe 14 to fail. To resist these forces, anti-rotational T-bars 43A, 43B, 43C, 43D extend radially outward from the pipe body 32. The T-bars 43A, 43B, 43C, 43D help to resist the force applied by the ground as various layers push and attempt to rotate the pipe 14 within the ground. The T-bars 43A, 43B, 43C, 43D may be made from the same material as the pipe body 32 or from another material known to those having skill in the art. Each T-bar 43A, 43B, 43C, 43D includes a first plate 44A, 44B, 44C, 44D extending radially from the pipe body 32 and a second plate 46A, 46B, 46C, 46D disposed perpendicular to the first plate 44A, 44B, 44C, 44D. The first plate 44A, 44B, 44C, 44D and second plate are formed as a single piece, and the first plate 44A, 44B, 44C, 44D is welded to the outer surface 34B of the pipe body 32. In other embodiments, the T-bars 43A, 43B, 43C, 43D may be formed together with the pipe body 32 or the first plates 44A, 44B, 44C, 44D may be formed together with the pipe body 32 while the second plates 46A, 46B, 46C, 46D are welded to the first plates 44A, 44B, 44C, 44D. As shown, the passage 22 an the hollow body 18 receive the T-bars 43A, 43B, 43C, 43D therethrough and contact a portion of the second plates 46A, 46B, 46C, 46D during use.

The plates 44A, 44B, 44C, 44D, 46A, 46B, 46C, 46D of the T-bars 43A, 43B, 43C, 43D, by extending from the pipe body 32, provide resistance to the rotational forces imparted by the earth as they act on the pipe 14 and soil stabilizer 10. In other words, the T-bars 43A, 43B, 43C, 43D provide resistance against the forces of the earth created upstream of the pipe assembly 10. These forces attempt to turn the pipe 32 over within the ground or otherwise attempt to rotate the pipe 32, and the T-bars 43A, 43B, 43C, 43D provide a larger surface area against which these rotational forces act thus helping to secure the pipe 14 upright within the ground. Without the T-bars 43A, 43B, 43C 43D, the pipe 14 may be inclined to break given the forces applied by the earth.

Figure 4A:
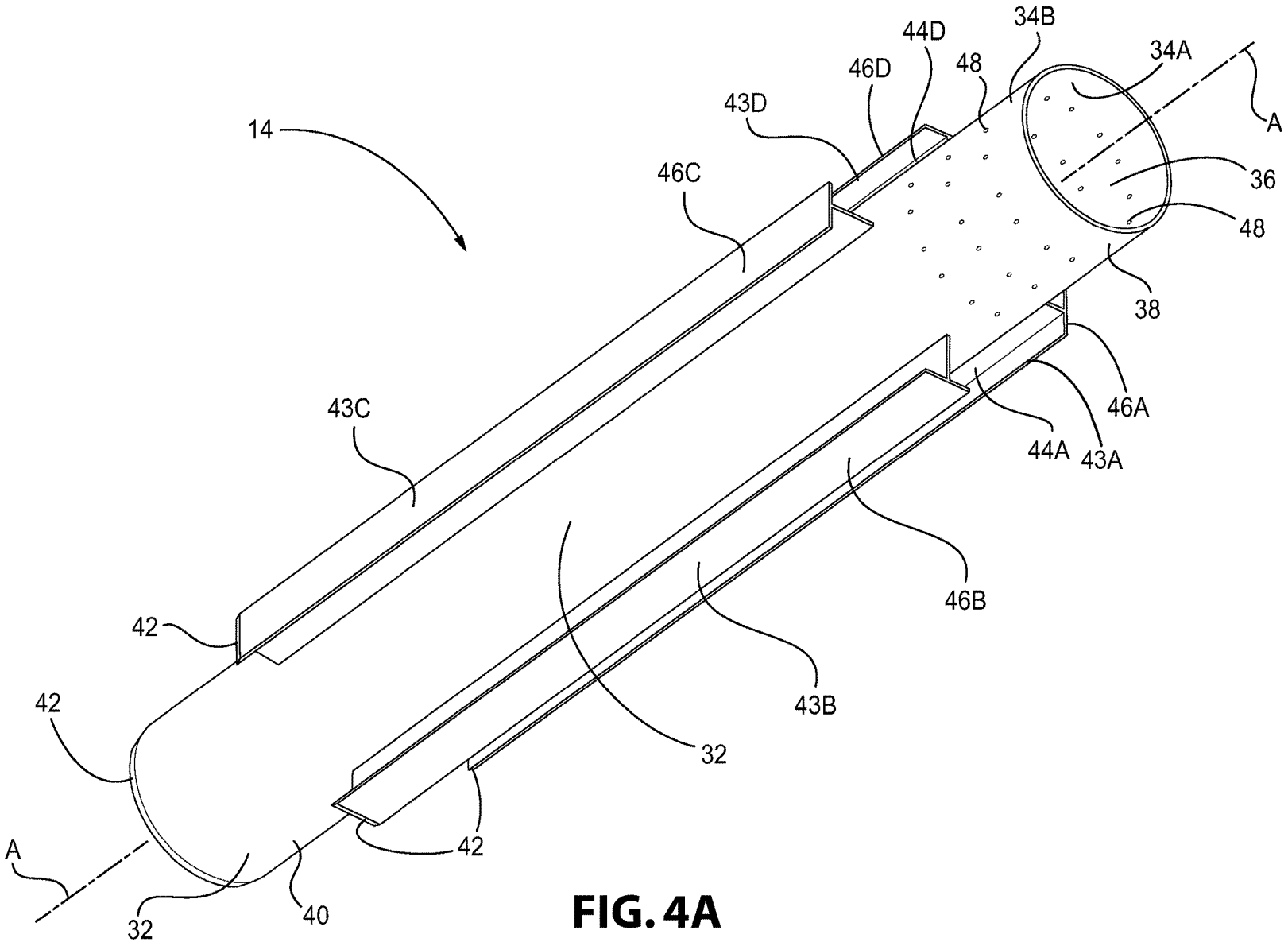
FIG. 4A is a perspective view of a pipe according to one embodiment or aspect of the present disclosure.
Figure 4B:
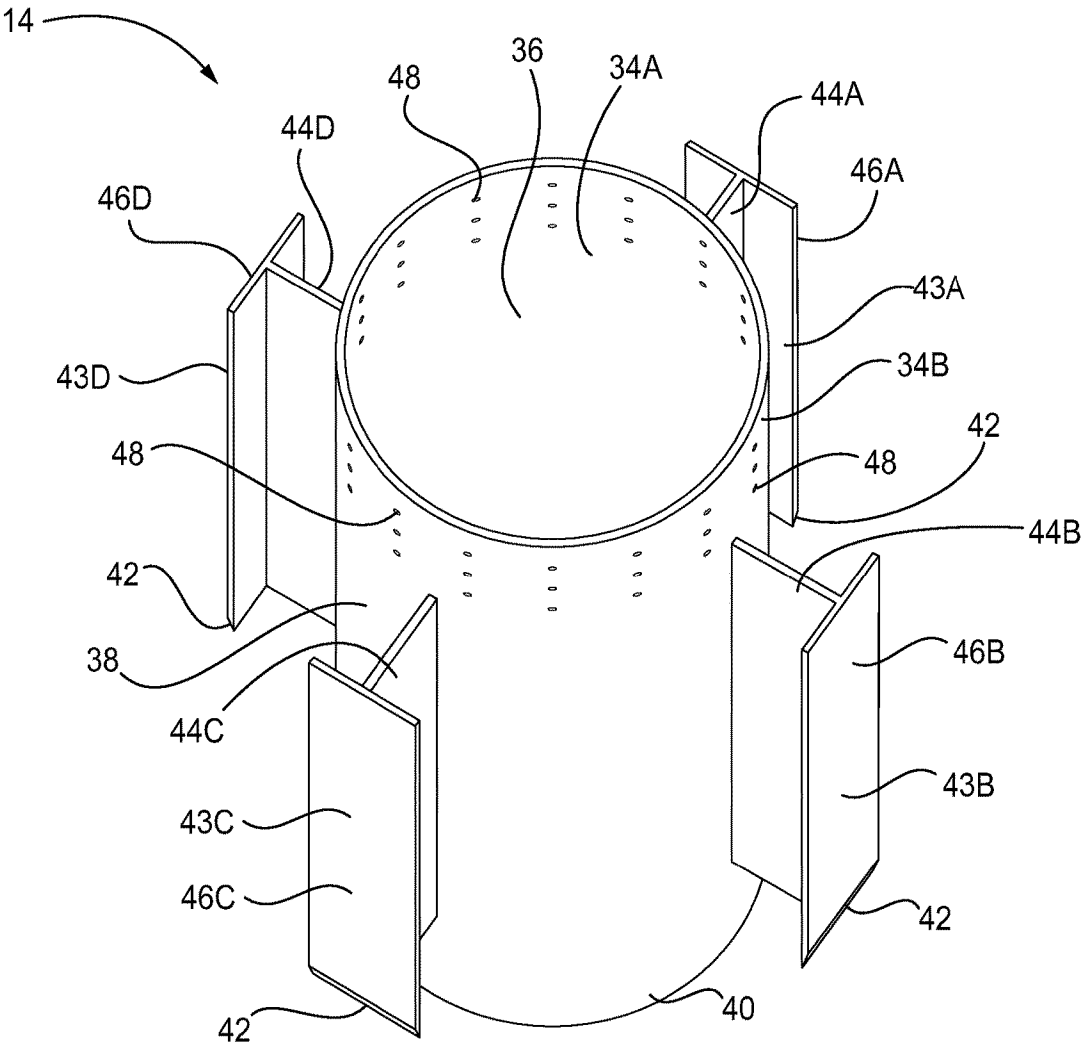
FIG. 4B is a top view of the pipe of FIG. 4A.
Figure 4C:
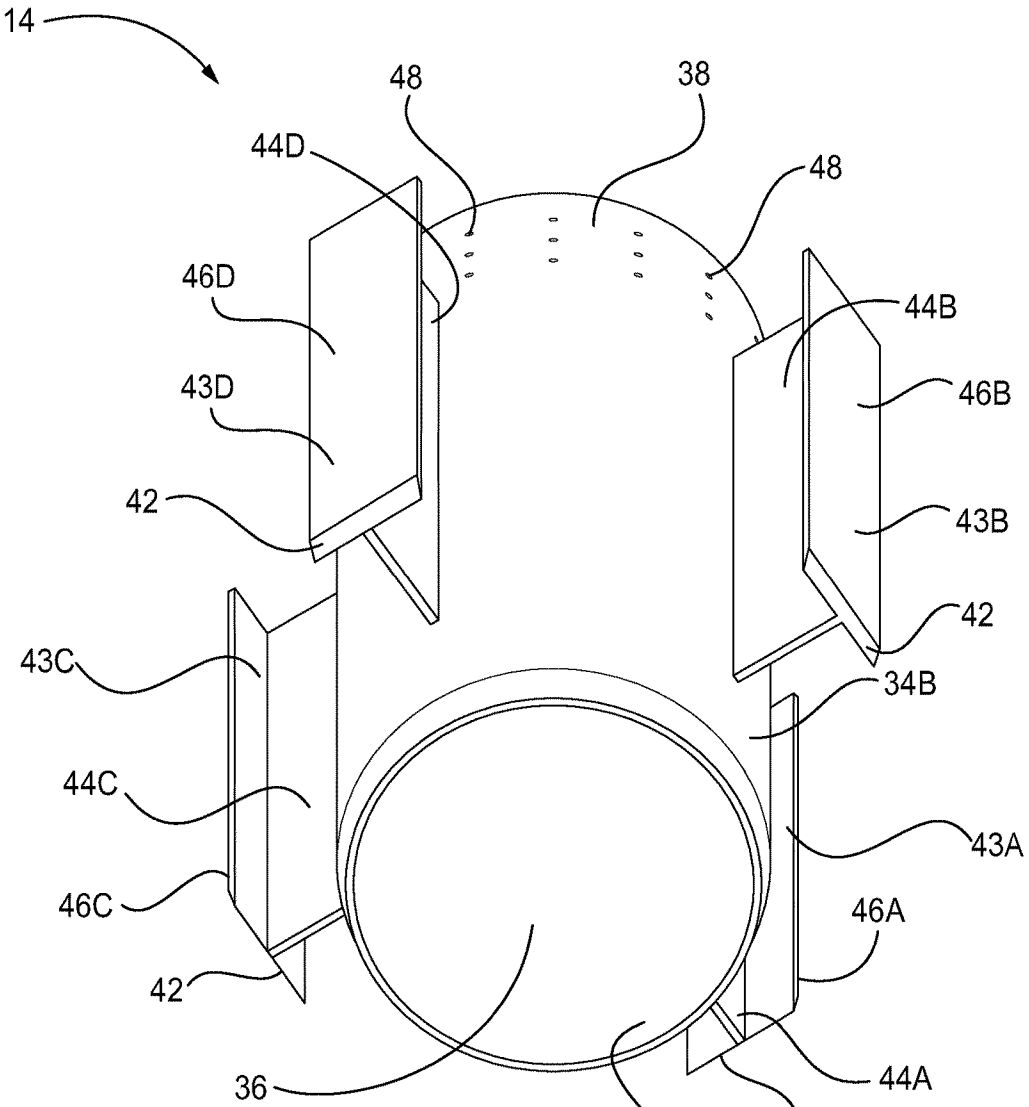
FIG. 4C is a bottom view of the pipe of FIG. 4A.
Figure 4D:
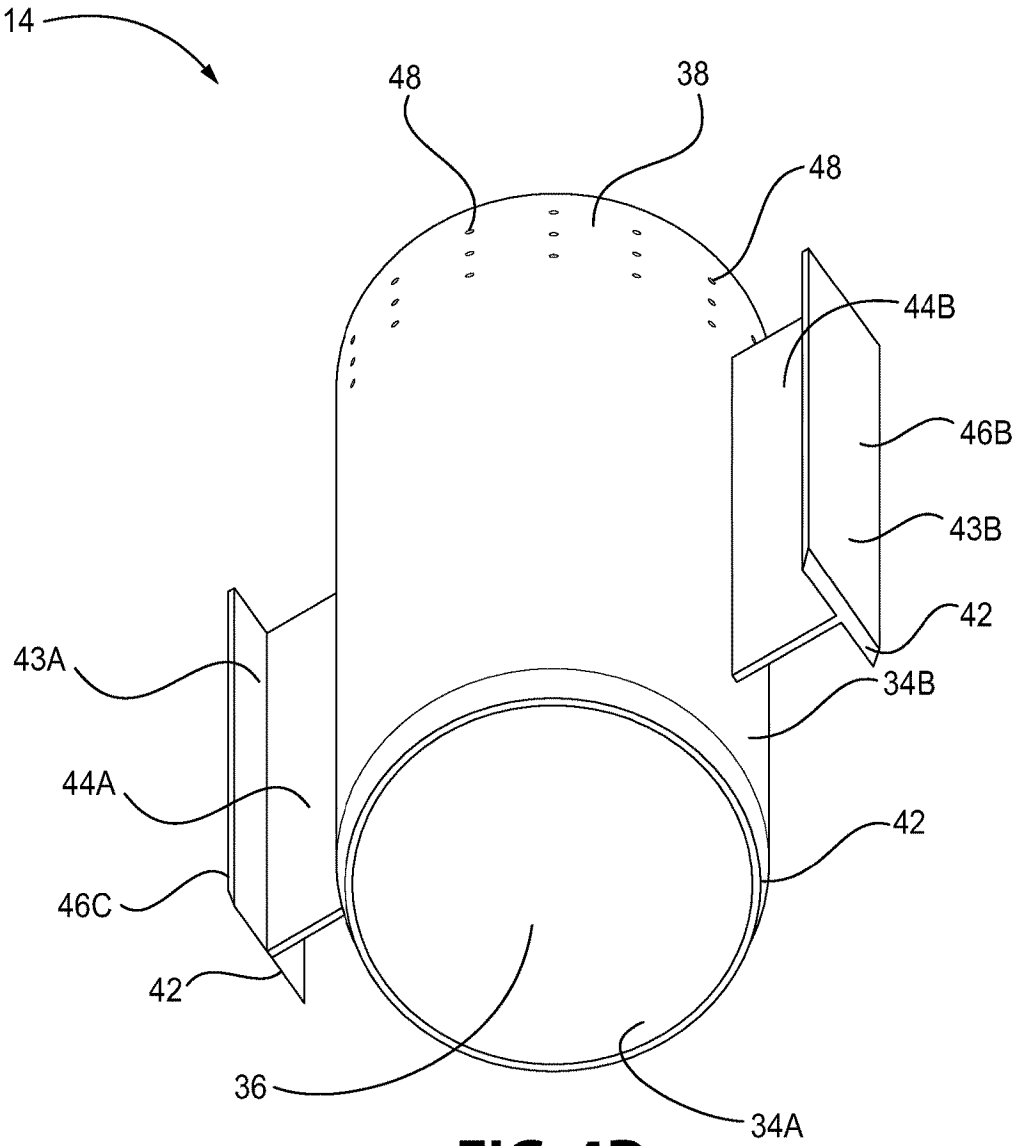
FIG. 4D is a bottom view of a pipe according to another embodiment or aspect of the present disclosure.
Figure 5A:
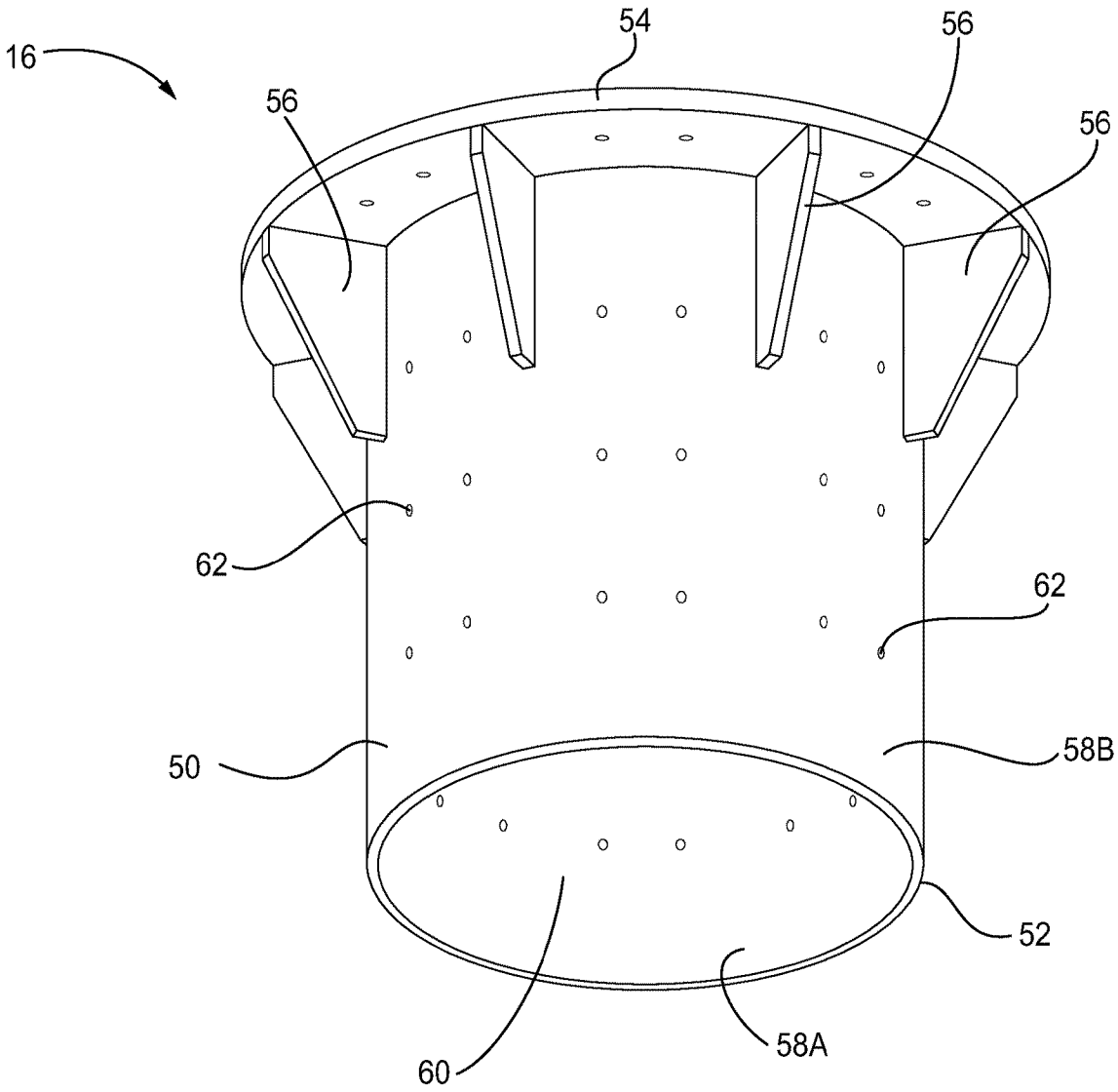
FIG. 5A is a first perspective view of a cap according to one embodiment or aspect of the present disclosure.
Figure 5B:
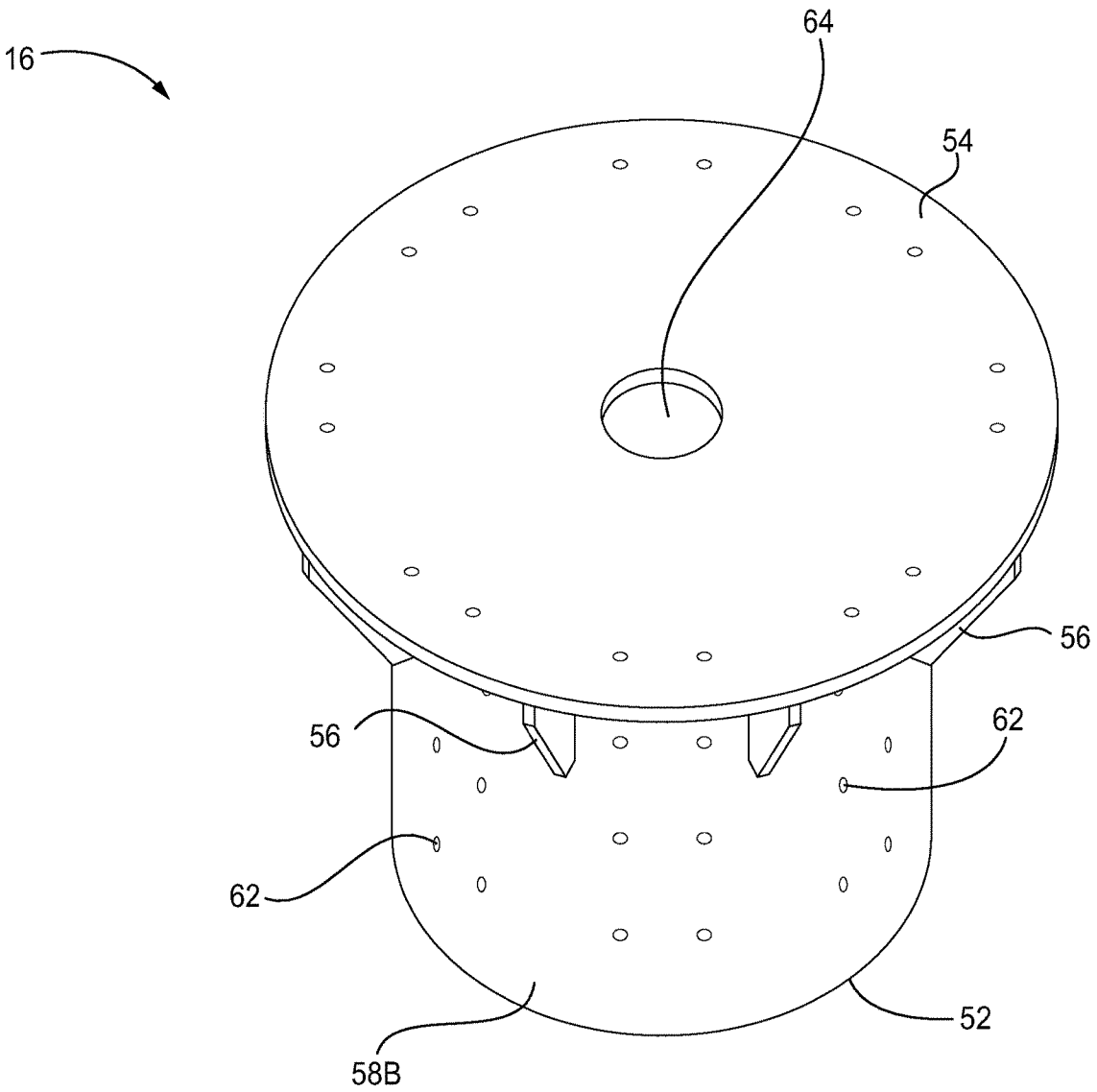
FIG. 5B is a second perspective view of the cap of FIG. 5A.

As shown in FIGS. 1, 2, and 4A-4C, four T-bars 43A, 43B, 43C, 43D are shown. As shown in FIG. 4D, two T-bars 43A, 43B are shown. The soil conditions will ultimately determine the number of T-bars 43A, 43B, 43C, 43D used. If the soil is relatively strong, either by having a lower risk of movement or by being made up of harder material, the pipe 14 may only need two T-bars 43A, 43B to resist rotational movement. In other, softer soil conditions, or in areas where there is lots of activity that may move the soil, four T-bars 43A, 43B, 43C, 43D may be used to resist rotational forces within the ground. In both embodiments, pairs of T-bars 43A, 43B, 43C, 43D oppose each other about the pipe body 32. In the first example, shown in FIG. 4D, T-bars 43A, 43B radially extend from the outer surface 34B of the pipe body 32 at the 90 and 270 degree points located about the pipe body 32 circumference. In the second example, shown in FIGS. 1, 2, 4A-4C, T-bars 43A, 43B, 43C, 43D radially extend from the outer surface 34B of the pipe body 32 at the 0, 90, 180, and 270 degree points located about the pipe body 32 circumference.

As shown, the T-bars 43A, 43B, 43C, 43D extend along a majority of the length of the pipe body 32; however, the T-bars 43A, 43B, 43C, 43D may extend along a variety of portions of the length of the pipe body 32. For example, if the pipe 14 extends through multiple types of soil during use, the portion(s) of the pipe body 32 extending through the softer portion(s) of soil may require T-bars 43A, 43B, 43C, 43D to be placed about those portion(s) of the pipe body 32. The portion(s) of the pipe body 32 extending through the harder portion(s) of soil may have two T-bars 43A, 43B or less extending from those portion(s) of the pipe body 32. For example, if a pipe 14 extends 30 feet into the soil, and the top eight feet of the soil consists of clay, then T-bars 43A, 43B, 43C, 43D may be applied along the length of the pipe body 32 disposed within the clay. If clay is present in the bottom five feet and the top five feet, then T-bars 43A, 43B, 43C, 43D may be applied to the lengths of the pipe body 32 disposed along those locations of the pipe body 32 and not along a middle portion of the pipe body 32 where the clay is not present.

The lengths of the T-bars 43A, 43B, 43C, 43D relative to the pipe body 32 may also vary depending on the soil conditions. In some applications the T-bars 43A, 43B, 43C, 43D may extend along most of the pipe body 32 as shown in the figures; however, in other applications, the T-bars 43A, 43B, 43C, 43D may only extend along 25-75% of the length of the pipe body 32. In other applications, the T-bars 43A, 43B, 43C, 43D may extend along more or less of the length of the pipe body 32. As should be apparent from this application, the specific features of each soil stabilizer 10 is determined by the condition of the soil into which the soil stabilizer 10 is being placed.

Like the second end 40 of the pipe body 32, the ends of the T-bars 43A, 43B, 43C, 43D closest to the second end 40 of the pipe body 32 include bevels 42. The bevels 42 help the ends of the first plates 44A, 44B, 44C, 44D and the second plates 46A, 46B, 46C, 46D cut into the earth as the pipe 14 is being driven into the ground. The bevels 42 drive the earth to the outer side of the pipe 32. In other words, the bevels 42 drive the earth in the direction of the outer surface 34B of the pipe body 32 as opposed to the direction of the inner surface 34A.

The first end 38 of the pipe body 32 includes a plurality of mounting holes 48. Only some mounting holes 48 are labeled for clarity. The mounting holes 48 facilitate the connection between the first end 38 of the pipe body 32 to the cap 16. As shown in FIGS. 1, 2, 5A, and 5B, the cap 16 is shown. The cap 16 includes a receiving end 52 for receiving the first end 38 of the pipe body 32 therein. The cap also includes a mounting plate 54 extending across and substantially perpendicular to the receiving end 52. Connections 56 extend between the mounting plate 54 and the receiving end 52 to facilitate a connection between the two. The connections 56 may be welded to both the receiving end 52 and the mounting plate 54 or they may be formed integral with one of the receiving end 52 or the mounting plate 54 and then welded to the other element with which it was not integrally formed.

The receiving end 52 of the cap 16 includes an inner surface 58A and an outer surface 58B and defines a passage 60 within the inner surface 58A. The passage 60 receives the first end 38 of the pipe 14 therein. The cap 16 includes a plurality of holes 62 that align with the plurality of mounting holes 48 located on the first end 38 of the pipe 14. Both holes 48, 62 align to receive attachment mechanisms 72 therethrough. While only two attachment mechanisms 72 are shown in FIGS. 1 and 2, up to 8-12 mechanisms 72 may be used to connect the cap 16 to the first end 38 of the pipe 14. The attachment mechanisms 72 may be bolts, screws, fasteners, or other devices known to those having ordinary skill in the art. Generally, for each foot of length that the receiving portion 50 of the cap 16 extends from the mounting plate 54, three holes 62 are aligned along both the receiving portion 50 and the first end 38 so that one or more attachment mechanisms can be applied therethrough.

On the mounting plate 54 of the cap 16, a mounting hole 64 is formed. The mounting hole 64 shares the axis A with the stabilizer 12, pipe 14, and cap 16. The mounting hole 64 can receive a bolt 72 or other fastening mechanism known to those having skill in the art. The soil stabilizer 10 with the bolt 72 extending through the mounting plate 54 of the cap 16 may permit external elements to be attached to one or more soil stabilizers 10. This is shown in FIG. 7 and will be discussed in more detail below.

As shown in FIG. 6, a completely constructed soil stabilizer 10 is shown extending through the surface 4 of the ground and into the soil 2. The construction and use of the soil stabilizer 10 will now be described. First, a hole is dug so that the stabilizer 12 can be placed a desired distance into the ground 2. As discussed above, the stabilizer 12 can be placed anywhere between 1-10 feet into the ground 2. The second end 40 of the pipe body 32 is then aligned within the stabilizer 12. In particular, the second end 40 of the pipe body 32 is aligned within the passage 22 of the hollow body 18. The hollow body 18 of the stabilizer 12 is shaped to fit the pipe body 32 and the T-bars 43A, 43B, 43C, 43D through the passage 22. Using machinery known to those having skill in the art, the pipe 14 is then driven through the hollow body 18 and into the ground 2 a desired depth, typically somewhere from 20-30 feet. The use of the stabilizer 12 prevents the need for extra equipment and power to drive the pipe 14 into the ground than if the stabilizer 12 was not provided. The stabilizer 12 allows the pipe 14 to stand up with the proper alignment before being driven into the ground, thus saving the need for extra equipment or power to drive the pipe 14 into the ground 2. After the pipe 14 is driven into the ground, with the various bevels 42 helping to facilitate the driving, the cap 16 and fastening mechanisms 70 are attached to the exposed first end 38 of the pipe body 32. The pipe 14 may then be driven entirely into the ground 2, or as described, a portion may remain above the surface 4 of the ground 2. As shown in FIGS. 6 and 7 a portion of the pipe 14 and cap 16 remain above the ground 2. By driving the pipe 14 of the soil stabilizer 10 into the ground 2, the ground 2 around the pipe 14 compacts and tightens around the pipe body 32 and T-bars 43A, 43B, 43C, 43D, thus forming a barrier to prevent further subsidence or loosening of the ground 2 at or near the soil stabilizer 10.

As shown in FIG. 7, a system of soil stabilizers 10 may be placed into the ground 2. The system is formed in the same manner as described above with distances of inches or feet extending between different soil stabilizers 10. A distance must be maintained between soil stabilizers 10 in order to allow ground water to travel between the soil stabilizers 10. In this formation, up to 98% of a hillside may be retained by placing multiple soil stabilizers 10 within a specific area of the hillside. The portion of the soil stabilizers 10 above the ground include at least a portion of the cap 16 and may include a portion of the pipe 14. By extending above the ground surface 4 and by including a bolt 72, the soil stabilizers 10 may be used as an anchor for a retaining wall 6 or another structure that can be built above the soil stabilizers 10. The retaining wall 6 may be used to further prevent landslides or demarcate one property from another. The retaining wall 6 may be concrete poured around a plurality of soil stabilizers 10 which may serve as anchors for the retaining wall 6. Other structures, such as a shed or barn, may also be built using the soil stabilizers 10 as a base support while simultaneously compacting the ground and preventing any subsidence of the earth.

While specific embodiments of the device of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the device of the present disclosure, which is to be given the full breadth of the claims appended and any and all equivalents thereof.

The invention claimed is:

1. A soil stabilizer assembly comprising:

a pipe comprising a first end configured to remain at least partially above ground, a second end configured to extend into the ground, a sidewall defining a hollow shaft extending between the first end and the second end, and a plurality of anti-rotational supports extending from an outer surface of the sidewall and configured to prevent rotation of the pipe;

a stabilizer connectable to the second end of the pipe, the stabilizer comprising a hollow body and a plurality of extensions extending radially outward from the body; and a cap connectable to the first end of the pipe, the cap comprising a receiving portion configured for receiving the first end of the pipe and a plate extending across the receiving portion, wherein the second end, at least a portion of the sidewall, and the anti-rotational supports of the pipe are configured to slide through the hollow body of the stabilizer, wherein the hollow body of the stabilizer is configured to receive the second end, the at least a portion of the sidewall, and the anti-rotational supports of the pipe therethrough, wherein the receiving portion of the cap is configured to receive the first end and at least a portion of the sidewall of the pipe therein, and wherein the hollow shaft of the pipe, the hollow body of the stabilizer, and the receiving portion of the cap are coaxially arranged.

2. The soil stabilizer assembly of claim 1, wherein the second end of the pipe comprises a bevel at a terminal edge.

3. The soil stabilizer assembly of claim 1, wherein the pipe is made from a polymer.

4. The soil stabilizer assembly of claim 1, wherein the plurality of anti-rotational supports extend at least partially into the ground.

5. The soil stabilizer assembly of claim 4, wherein the plurality of anti-rotational supports are T-bars.

6. The soil stabilizer assembly of claim 5, wherein the plurality of anti-rotational supports comprise four T-bars equally spaced apart from each other about a circumference of the sidewall and positioned between the first end and the second end.

7. The soil stabilizer assembly of claim 6, wherein the ends of the T-bars nearest the second end of the pipe each comprise a bevel at a terminal edge.

8. The soil stabilizer assembly of claim 1, wherein the plurality of extensions is four extensions.

9. The soil stabilizer assembly of claim 1, wherein each of the plurality of extensions terminates in a cylinder, and wherein at least one of the cylinders comprises a central hole configured to receive a stabilizing pin therethrough.

10. The soil stabilizer assembly of claim 1, wherein, proximate the first end of the pipe, the hollow shaft of the pipe comprises a first plurality of holes, and wherein the receiving portion of the cap comprises a second plurality of holes, the first and second pluralities of holes are configured to align in order to receive at least one attachment element therethrough to secure the cap to the sidewall.

11. The soil stabilizer assembly of claim 1, wherein the plate of the cap comprises an opening coaxial with the hollow shaft of the pipe, the hollow body of the stabilizer, and the receiving portion of the cap, the opening configured to receive a support mechanism therethrough.

12. The soil stabilizer assembly of claim 11, wherein the support mechanism is configured to attach the soil stabilizer to a different soil stabilizer.

13. A ground retention system, the system comprising:

a plurality of soil stabilizers, each soil stabilizer comprising:

a pipe comprising a first end, a second end, and a sidewall extending between the first end and the second end, the sidewall defining a hollow shaft;

a plurality of anti-rotational supports extending from an outer surface of the sidewall and configured to prevent rotation of the pipe;

a stabilizer comprising a hollow body and a plurality of extensions extending radially outward from the hollow body; and a cap comprising a receiving portion configured for receiving the first end of the pipe therein and a plate extending across the receiving portion, wherein the second end, at least a portion of the sidewall, and the anti-rotational supports of the pipe are configured to slide through the hollow body of the stabilizer, wherein the hollow body of the stabilizer is configured to slide over and receive the second end, the at least a portion of the sidewall, and the anti-rotational supports of the pipe therethrough, wherein the second end and at least a portion of the sidewall of the pipe extend at least partially into the ground, wherein the hollow shaft of the pipe, the hollow body of the stabilizer, and the receiving portion of the cap are coaxial, and wherein each of the soil stabilizers is separated from an adjacent soil stabilizer by a distance.

14. The ground retention system of claim 13, wherein the second end of the pipe comprises a bevel at a terminal edge.

15. The ground retention system of claim 13, wherein at least a portion of the plurality of anti-rotational supports extend into the ground.

16. The ground retention system of claim 15, wherein the plurality of anti-rotational supports are T-bars extending along a least a portion of a length of the sidewall between the first and second ends.

17. The ground retention system of claim 16, wherein an end of the T-bars nearest the second end of the pipe comprise a bevel at a terminal edge.

18. The ground retention system of claim 13, wherein the plate of the cap is configured to receive a support mechanism therein, the support mechanism being coaxial with the hollow shaft of the pipe, the hollow body of the stabilizer, and the receiving portion of the cap.

19. The ground retention system of claim 18, wherein the support mechanism of each soil stabilizer is configured to connect with the support mechanism of at least one other soil stabilizer.

20. A method of stabilizing a portion of soil, the method comprising the steps of:

inserting a stabilizer to a first distance into the ground, the stabilizer comprising a hollow body and a plurality of extensions extending from the hollow body;

aligning a pipe within the hollow body of the stabilizer, the pipe comprising a first end, a second end, and a sidewall extending therebetween, the sidewall defining a hollow shaft and comprising a plurality of anti-rotational supports extending between a first end and a second end along at least a portion of a length of the sidewall, the plurality of anti-rotational supports being configured to prevent rotation of the pipe;

driving the first end of the pipe into the ground a second distance, the second distance greater than the first distance, such that at least a portion of the sidewall and at least a portion of the plurality of anti-rotational supports are slidably received within the stabilizer; and applying a cap to the second end of the pipe remaining above ground, wherein the hollow shaft of the pipe, the hollow body of the stabilizer, and a receiving portion of the cap are coaxial, the receiving portion being configured to receive the second end of the pipe therein, and wherein, after the driving step, the anti-rotational supports extend at least partially into the ground.

* * * * *